US012560394B1

(12) United States Patent
Pain On Hip

(10) Patent No.: US 12,560,394 B1
(45) Date of Patent: Feb. 24, 2026

(54) FIREARM MONITORING DEVICES, SYSTEMS, AND METHODS

(71) Applicant: Virgil Pain On Hip, Sharpsburg, MD (US)

(72) Inventor: Virgil Pain On Hip, Sharpsburg, MD (US)

( * ) Notice: Subject to any disclaimer, the term of this patent is extended or adjusted under 35 U.S.C. 154(b) by 152 days.

(21) Appl. No.: 18/586,772

(22) Filed: Feb. 26, 2024

Related U.S. Application Data

(60) Provisional application No. 63/487,188, filed on Feb. 27, 2023.

(51) Int. Cl.
*F41A 17/06* (2006.01)
*F41C 33/06* (2006.01)

(52) U.S. Cl.
CPC ..... *F41A 17/063* (2013.01); *F41C 33/06* (2013.01)

(58) Field of Classification Search
CPC ..... F41A 17/063; F41C 33/06
USPC ..... 340/532
See application file for complete search history.

(56) References Cited

U.S. PATENT DOCUMENTS

| | | | | |
|---|---|---|---|---|
| 7,200,965 | B2 | 4/2007 | Tomb | |
| 8,127,482 | B2 | 3/2012 | O'Shaughnessy et al. | |
| 8,726,556 | B1 | 5/2014 | Willingham | |
| 8,819,979 | B2 | 9/2014 | Kelly | |
| 9,057,571 | B2 | 6/2015 | Kemmerer et al. | |
| 9,115,944 | B2 | 8/2015 | Arif | |
| 9,196,139 | B2 | 11/2015 | Gutierrez et al. | |
| 9,400,150 | B2 | 7/2016 | Stewart et al. | |
| 9,404,698 | B2 | 8/2016 | Stewart et al. | |
| 9,435,597 | B2 | 9/2016 | Goren et al. | |
| 9,752,840 | B1 | 9/2017 | Betro | |
| 9,824,558 | B2 * | 11/2017 | Warren | G08B 13/1436 |
| 9,829,275 | B2 | 11/2017 | Madrid et al. | |
| 9,892,607 | B2 | 2/2018 | Hemanes | |
| 10,378,844 | B2 | 8/2019 | Patches et al. | |
| 10,386,143 | B2 * | 8/2019 | Jones | G08B 13/1436 |
| 10,395,493 | B1 * | 8/2019 | Simmons | G08B 13/14 |
| 10,444,042 | B1 * | 10/2019 | Radcliff | G01J 1/42 |

(Continued)

FOREIGN PATENT DOCUMENTS

| | | |
|---|---|---|
| EP | 2715696 | 9/2016 |
| KR | 102161518 B1 | 10/2020 |

*Primary Examiner* — Kerri L McNally
(74) *Attorney, Agent, or Firm* — Nemphos Braue LLC; Michael Antone

(57) ABSTRACT

A firearm safety sensing system for the monitoring and detection of firearm movement including a firearm storage device configured to store a firearm, a firearm monitoring device including one or more processors, sensors, and communication interfaces. The sensors are positioned to sense when either the firearm stored in the firearm storage device and/or the firearm storage device changes position relative to the sensors and may detect when the firearm storage device has been opened or unlocked. The processor receives sense signals, determine whether the sense signal represents a change in position of the firearm relative to the sensors, and send, via a communication interface and firearm monitoring device, a change in position notification to the user and may receive instructions to execute from the user. A user may manually or automatically prevent the firearm storage device from being opened. Multi-factor authentication may be enabled if power or communications are disrupted.

20 Claims, 7 Drawing Sheets

(56) References Cited

U.S. PATENT DOCUMENTS

| | | | | |
|---|---|---|---|---|
| 10,750,431 | B2 | 8/2020 | Juhasz et al. | |
| 11,674,768 | B2 | 6/2023 | Mogaka | |
| 2005/0066567 | A1 | 3/2005 | Newkirk | |
| 2008/0204231 | A1 | 8/2008 | Hietanen et al. | |
| 2010/0315235 | A1 | 12/2010 | Adegoke | |
| 2010/0324859 | A1 | 12/2010 | McNelis et al. | |
| 2014/0202058 | A1* | 7/2014 | Zhou | F41A 17/063 42/70.11 |
| 2014/0284323 | A1 | 9/2014 | Albrecht et al. | |
| 2014/0290109 | A1 | 10/2014 | Stewart et al. | |
| 2017/0010062 | A1 | 1/2017 | Black et al. | |
| 2017/0186287 | A1 | 6/2017 | Schlake | |
| 2018/0232221 | A1 | 8/2018 | Corinella | |
| 2019/0186868 | A1* | 6/2019 | Cordero Pardo | F41C 33/029 |
| 2019/0333090 | A1 | 10/2019 | Roeding et al. | |
| 2020/0074823 | A1* | 3/2020 | Brikho | G08B 13/1427 |
| 2022/0051535 | A1* | 2/2022 | Siner, Jr. | G08B 13/19695 |

* cited by examiner

FIREARM MONITORING DEVICES, SYSTEMS, AND METHODS

CROSS-REFERENCE TO RELATED APPLICATIONS

This application claims the benefit of and priority to U.S. Provisional Patent Application No. 63/487,188 filed Feb. 27, 2023, the disclosure of which is incorporated herein by reference.

STATEMENT REGARDING FEDERALLY SPONSORED RESEARCH OR DEVELOPMENT

Not Applicable

BACKGROUND OF THE INVENTION

Field of the Invention

The present invention relates to protecting valuable items and weapon safety systems. More specifically, the present invention relates to a firearm monitoring system to monitor the movement of a firearm and notify a user of movement.

Background

Safe storage and use of firearms has been a challenge since the development of firearms, since firearms are weapons designed to inflict injury/damage on the subject under fire. Over the years, there have been a great multitude of inventions designed to assist firearms owners with the protection of their firearms. These inventions have achieved various levels of success in assisting firearms owner with safely storing and using their firearms.

One of the challenges of safely storing firearms is that safe storage must be balanced against the most important purpose of a firearm in many instances, which is self-defense that requires at least quick, if not immediate, accessibility. For example, storing your firearm in a bank vault may be a very safe way to store your firearm, but renders it useless in a self-defense emergency when you need immediate access. Conversely, leaving a loaded firearm on the kitchen counter provides immediate access in case of emergency, but exposes the firearm to potential misuse and/or theft.

As such, there is a continuing need for firearm safety systems that provide improved levels of safety and accessibility.

BRIEF SUMMARY OF THE INVENTION

The present invention provides firearm safety systems, devices, and methods for monitoring and detecting firearm movement. In various embodiments, the firearm safety system includes a firearm monitoring device including at least one sensor and configured to send a notification to a user when there is movement/change in the position or state of a firearm relative to the firearm monitoring device and/or the opening or unlocking of a storage device, e.g., case, rack, safe, etc. and may receive instructions to execute from the user.

In various embodiments, the firearm monitoring device may be integrated, or used in combination with various firearm storage devices, such as holsters, cases, wall mounts, racks, safes, etc. The firearm monitoring device may include one or more sensors, such as pressure, motion, contact, RFID, light, gyroscope, accelerometer, etc. positioned to sense a change in the position or state of the firearm relative to the sensor. In various embodiments, a first portion of the sensor may be attached to the firearm, such as an RFID tag, magnetic strip, reflector, etc. that cooperates with a second portion of the sensor that is at least coupled to the firearm monitoring device.

The firearm monitoring device may further include one or more processors in communication with the sensors to receive signals from the sensor and determine when differences in the signals received from the sensors indicate a change in the position of the firearm relative to the sensor. The processor being further configured to send a notification to a user of the system that there has been a change in the position or state of the firearm or the storage device has been opened, unlocked, moved, etc. A user may manually or automatically prevent the firearm storage device from being opened, such as by disabling a fingerprint sensor lock, disengaging a physical lock, etc. The firearm monitoring system may be configured to require multi-factor authentication when the firearm storage device is moved.

In various embodiments, the firearm monitoring device may include one or more communications interfaces in communication with the processors to send notifications to the user of a change in position of the firearm. The communications interfaces and processors may also be configured to receive input signals from the user for various purposes, such as configuring setting for firearm storage device. The communication interfaces may include one or more wired and/or wireless transmitters, receivers, and/or transceivers, e.g., radios, providing from communication via one or more protocols.

In various embodiments, the firearm storage device may transmit a change of position notification signal to a firearm monitoring platform, which will, in turn, send the change of position notification to the user of the firearm safety system.

In various embodiments, the firearm monitoring device may further include various emitters, light, sound, vibration, etc. that are used to put a person attempting to change the position of the firearm on notice that the movement of the firearm has been sensed. It will be appreciated that it may be desirable to confirm that the notification has been received by the user before placing the person attempting to move the firearm on notice that the movement has been sensed.

In operation, the firearm monitoring device is positioned relative to the firearm and/or storage devices, such that movement of the storage device and/or the firearm in the storage device is sensed by the sensors in the firearm monitoring device. The sensing signal from the sensor is provided to the processors, which, in turn, transmit a notification to the users, either directly or via the firearm monitoring platform. In various embodiments, if the user does not confirm receipt of the notification, then the firearm monitoring device and/or firearm monitoring platform may contact other contacts as may be designated by the user.

Accordingly, the present disclosure addresses the continuing need for firearm safety systems to improve levels of safety and accessibility.

BRIEF DESCRIPTION OF THE DRAWINGS

The accompanying drawings are included for the purpose of exemplary illustration of various aspects of the present invention, and not for purposes of limiting the invention, wherein.

Figure 1:
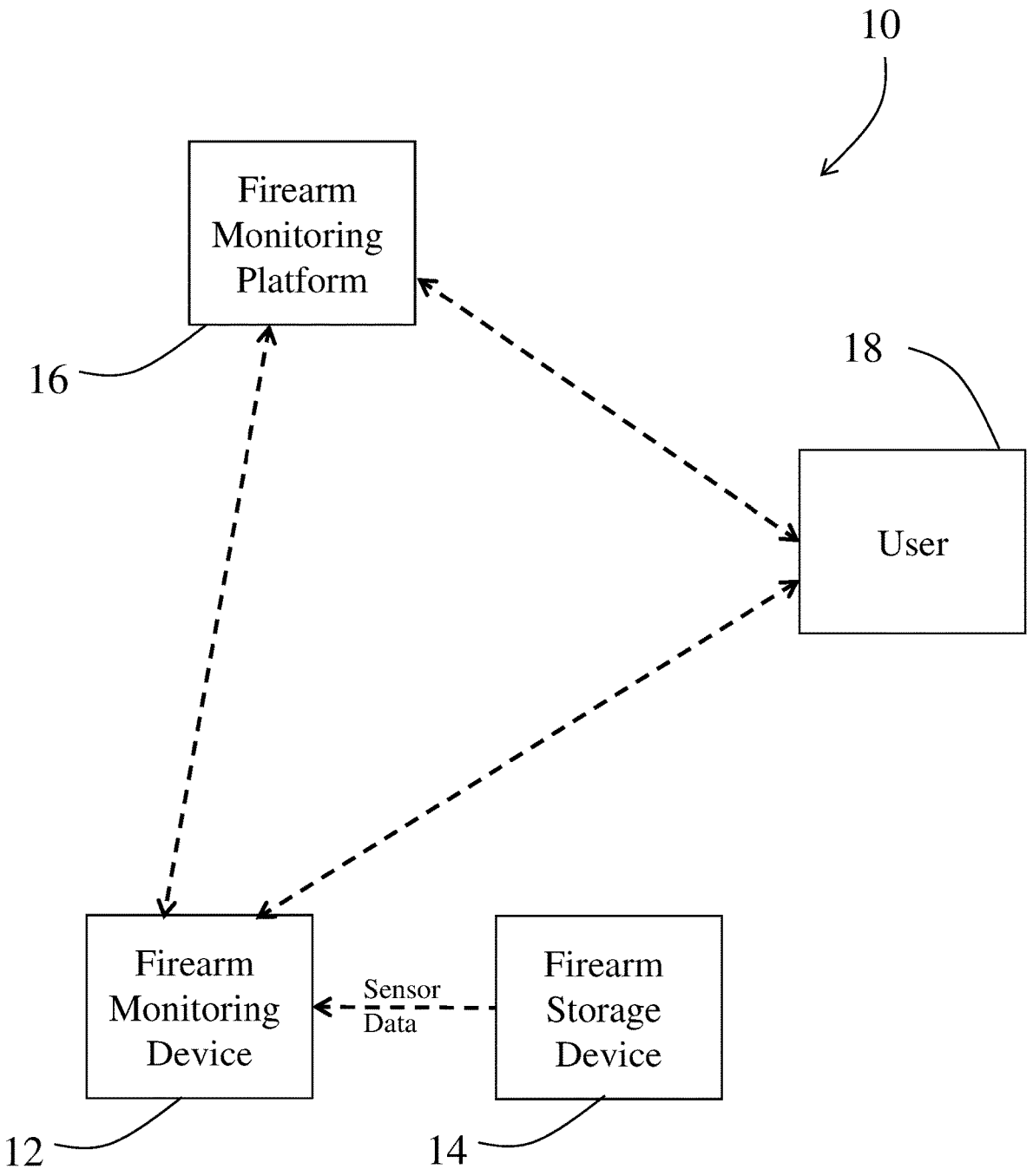
FIG. 1 shows exemplary embodiments of the firearm monitoring system.

In the drawings and detailed description, the same or similar reference numbers may identify the same or similar elements. It will be appreciated that the implementations, features, etc. described with respect to embodiments in specific figures may be implemented with respect to other embodiments in other figures, unless expressly stated, or otherwise not possible.

DETAILED DESCRIPTION OF THE INVENTION

FIG. 1 depicts exemplary embodiments of a firearm monitoring system 10 of the present invention. The system 10 may include a firearm monitoring device 12, a firearm storage device 14, and a firearm monitoring platform 16 in communication with a user 18. It will be appreciated that while the firearm monitoring device 12 and firearm storage device 14 are shown as separate blocks in the figure that the firearm monitoring device 12 may be positioned on, within or outside of firearm storage device 14, as will be further described herein.

The firearm storage device 14 may include any of the known types of firearm storage devices, such as firearm cases, safes, holsters, racks, etc. The firearm monitoring platform 16 may include one or more computers present locally or remotely, e.g., cloud or dedicated equipment and service, from the firearm monitoring device 12 and configured to receive firearm movement/change in position ("CIP") notification signals from the firearm monitoring device 12 and send those notifications to the user 18 of the system 10.

Communication with the user 18 may be via one or more communication methods, such as text, email, telephone, app, etc. as is known to be one of skill in the art. The firearm monitoring platform 16 may perform other tasks, such as storing movement/CIP notifications, monitoring and configuring the operational state of the firearm monitoring device 12, providing user and system administrators access to settings and stored data, etc.

In various embodiments, user set-up and operation of the system 10 may be provided a software as a service providing access to a user interface on the firearm monitoring platform 16, such as via a browser interface, and/or via a software application (i.e., mobile app) running on a computing device, such as a mobile phone, tablet, etc. In other embodiments, the firearm monitoring platform 16 may be embodied as a stand alone software application that communicated directly with the firearm storage device 14, such as via Bluetooth, NFC, etc., or indirectly via a network, such as a cellular network, or a stand alone software as a service application communicating via a network.

Figure 2:
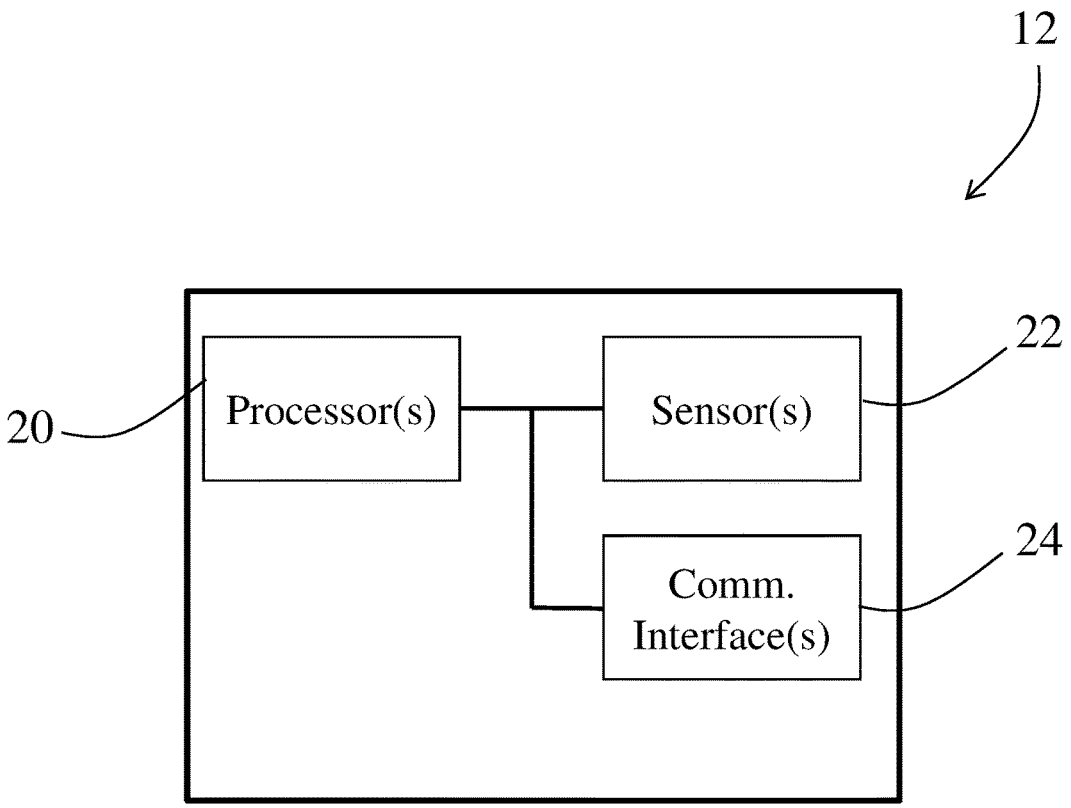
FIG. 2 shows exemplary embodiments of the firearm monitoring device.

As depicted in FIG. 2, the firearm monitoring device 12 may include one or more processors 20, sensors 22, and communication interfaces 24, which may be powered by batteries contained within or proximate the firearm monitoring device 12 and/or an electrical power distribution system via a wall plug (not shown). In various embodiments, the processors 20 run software instructions, that may be stored on a non-transitory computer readable medium, to receive sense signals from the sensors, determine whether the sense signal represents a change in position of the firearm and/or firearm storage device 14 relative to the sensors 22, and send a change in position notification to the user 18 via the communication interfaces 24 when the processors 20 determine there has been a change in position. The software instructions may also provide for other notifications in the system 10, such as operational checks, power status, e.g., low battery power, to be sent to the user and/or firearm monitoring platform 16.

In various embodiments, the firearm monitoring device 12 may send the notification directly to a device of the user 18, such as via a text message, and/or indirectly via the firearm monitoring platform 16. It will be appreciated that for direct notifications to the user 18, the firearm monitoring device 12 will require telephone or other service that enables a direct transmission to the user's device, generally through a service provider network. In various embodiments, notifications from the firearm monitoring device 12 will be sent indirectly to the user 18 via the firearm monitoring platform 16 through an internet connection.

The communication interfaces 24, as noted below, may be selected by the skilled artisan to suit particular applications. For example, WiFi, and/or Bluetooth transmitter and receivers may be separately provided or integrated in transceivers to enable the firearm monitoring device 12 to communicate with user directly and/or indirectly via the firearm monitoring platform 16 using an available network at the location of the firearm monitoring device 12. The communication interfaces 24 may also employ wired connections, but the wired connections may not be suitable for some applications.

Figure 3:
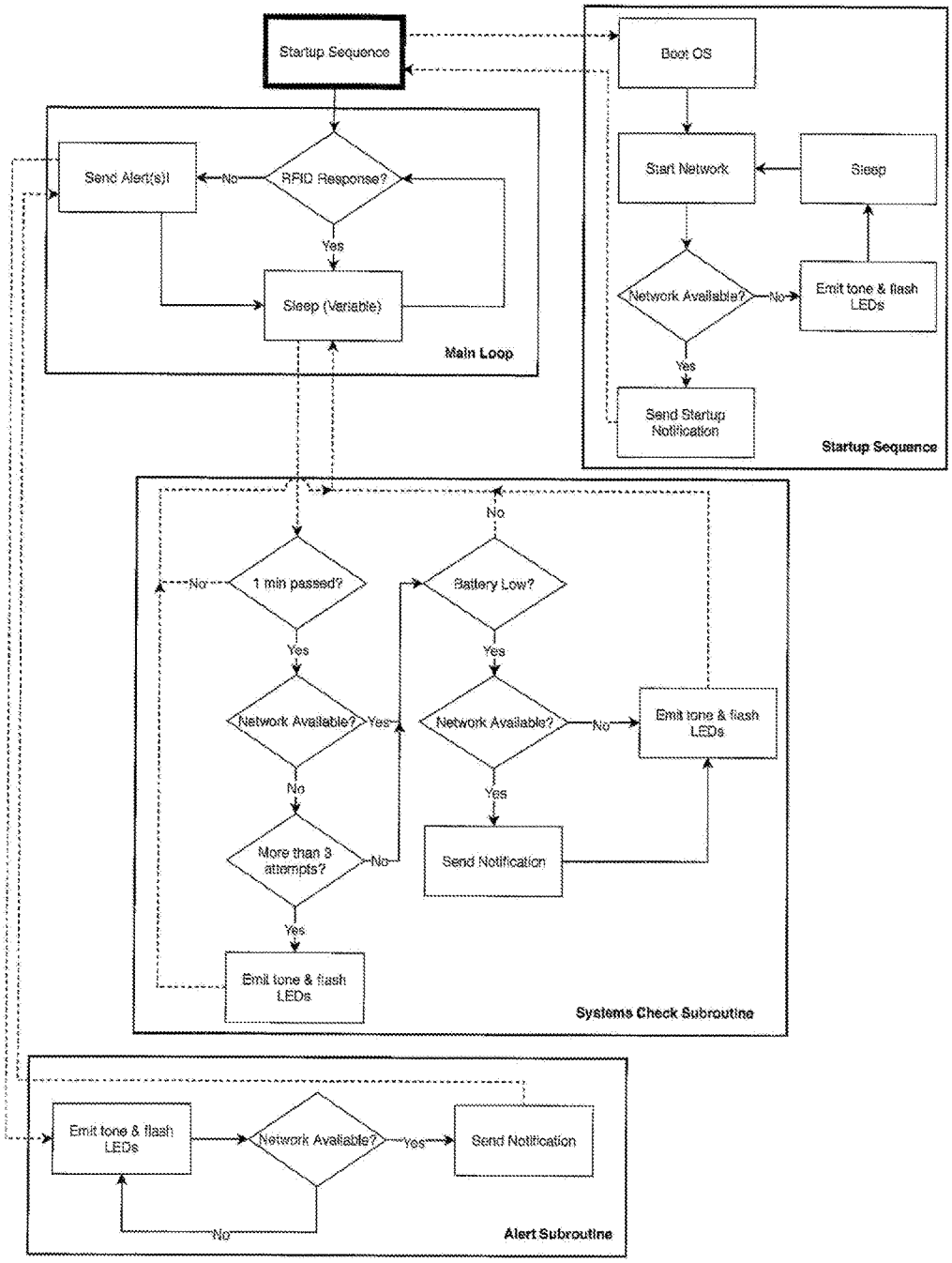
FIGS. 3 & 4 show exemplary embodiments of the startup and monitoring procedure.
Figure 4:
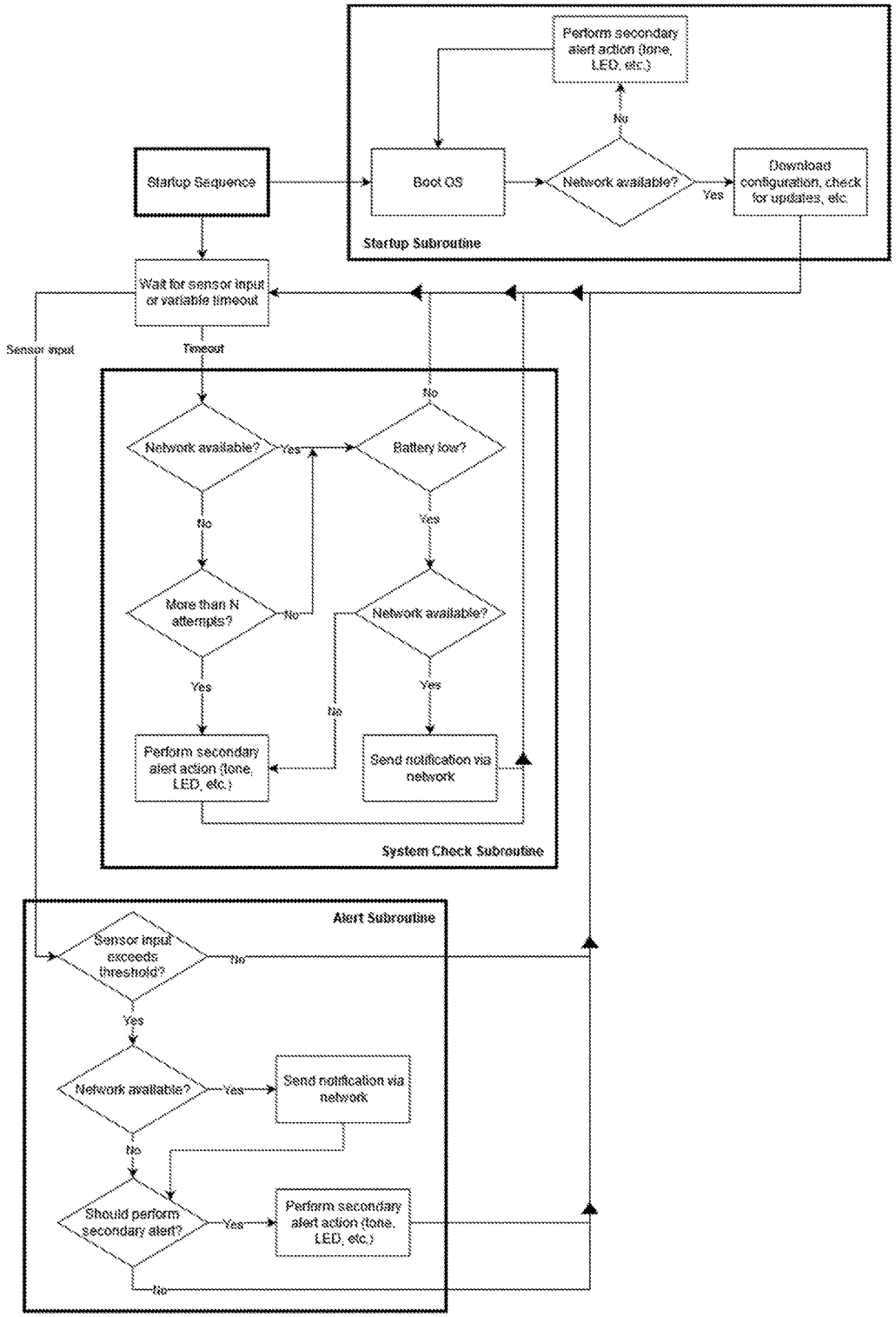

FIGS. 3 & 4 depict exemplary operating sequence for the firearm monitoring device 12. As depicted in FIG. 3, upon powering up, a start sequence is initiated as depicted in the Startup Sequence block in which an operating system (OS) is initialized, then network communication is initiated. If a network is available, the startup sequence is completed by returning a startup notification from the block. If a network is not available, an error notification may be provided by the firearm monitoring device 12, such as emitting a sound and/or light, which may be followed by one or more attempts at making a network connection before the system times out.

When the firearm monitoring device 12 boots properly and a network connection is established, the processor(s) 20 of the firearm monitoring device 12 begin executing the Main Loop in which the input from the various sensors 22, e.g., RFID monitor, is monitored to detect movement/CIP of the firearm and/or firearm storage device 14. If the sensor 22 provides a response, then the loop may enter a sleep sequence including a system check subroutine as depicted in the System Check Subroutine block. After a period of time, e.g., 1 minute, the processor(s) 20 will check the network availability via the communication interface(s) 24. If the network is available, then the processor(s) 20 will check the battery status. If the battery status is not low, i.e., good, then the process will return to the Main Loop and continue to monitor the sensors 22. If the system check finds that the network is not available, the battery power is low, or other system parameter is out of specification, then the processor(s) 20 may provide a notification, such as emitting a sound and/or light, on the firearm monitoring device 12.

If the Main Loop detects a change in response from the sensor 22, the processor(s) 20 will initiate an alert subroutine, which may provide a notification on the firearm monitoring device 12, such as emitting a sound and/or light. The alert subroutine will send a notification of the detected movement/CIP of the firearm and/or firearm storage device 14 to user 18 directly or indirectly via the firearm monitoring platform 16.

As depicted in FIG. 4, upon powering up, a start sequence is initiated as depicted in the Startup Sequence block in which an operating system (OS) is initialized and the software check for network availability in a startup subroutine, then network communication is initiated. If a network is not available, one or more secondary alert notifications may be provided by the firearm monitoring device 12, such as emitting a sound and/or light, which may be followed by one or more attempts at making a network connection before the system times out. If a network is available, the software may download configurations, check for updates, etc.

When the firearm monitoring device 12 boots properly and a network connection is established, the processor(s) 20 of the firearm monitoring device 12 may execute System Check Subroutine instructions if the processor(s) 20 times out while awaiting sensor input. The System Check Subroutine may confirm network availability and the battery level, perform secondary alert actions, send notifications, such as low battery, via the network, as well as reset the timeout if the network is available and the battery level is above a low battery amount.

When the processor(s) 20 receive sensor input, the processor(s) 20 will initiate an Alert Subroutine. The sensor input may be compared to a sensor threshold to provide the user 18 with sensitivity control or the routine may be configured to send a notification if any sensor input is received. In threshold embodiments, if the sensor input does not exceed the threshold, the system 10 may not send any alerts or a different type of alert. The system 10 may store the sensor input whether or not an alert is not sent and the type of alert, if sent.

If the sensor input exceeds the threshold, then if the network is available a notification may be sent to the user 18. If the network is not available and/or after the notification is sent via the network, the instructions may determine whether or not to perform a secondary alert action. For example, for some sensor input, it may or may not be desirable or desired to provide a secondary alert, such as when the user 18 is proximate to the firearm storage device 14, etc.

Figure 5A:
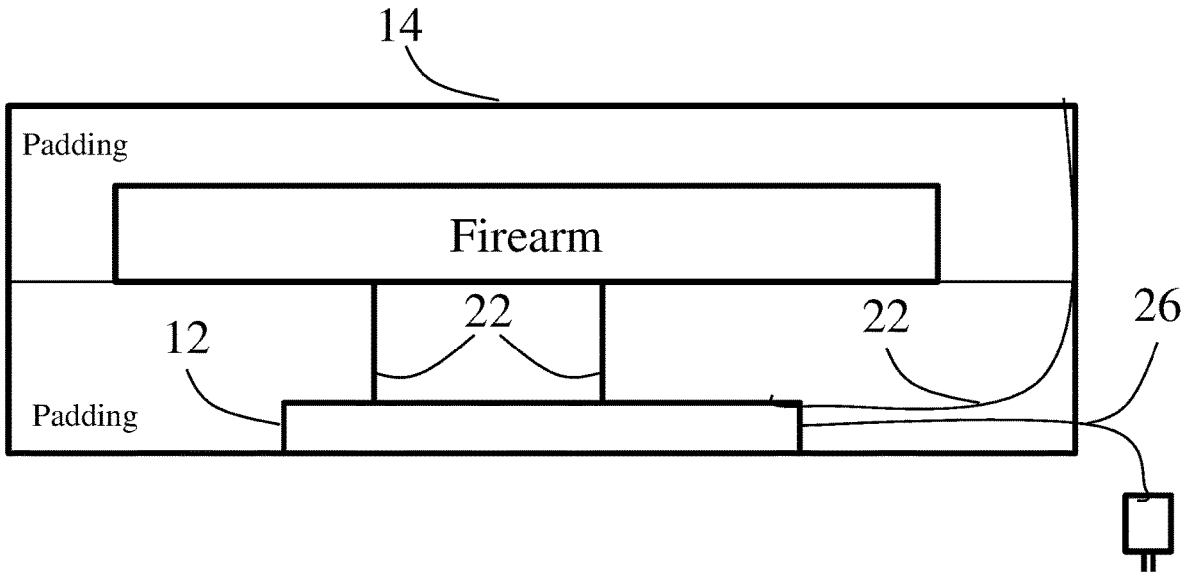
FIG. 5A-5C show exemplary cross-sectional views of various embodiments of the firearm storage device.
Figure 5B:
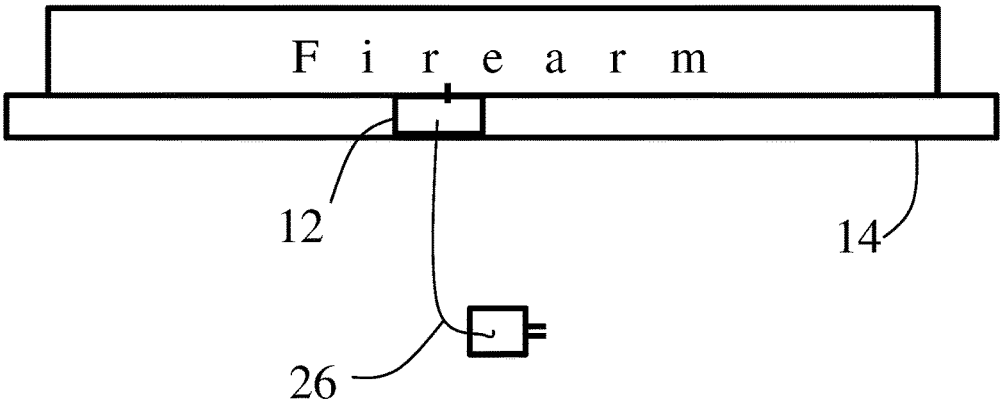
Figure 5C:
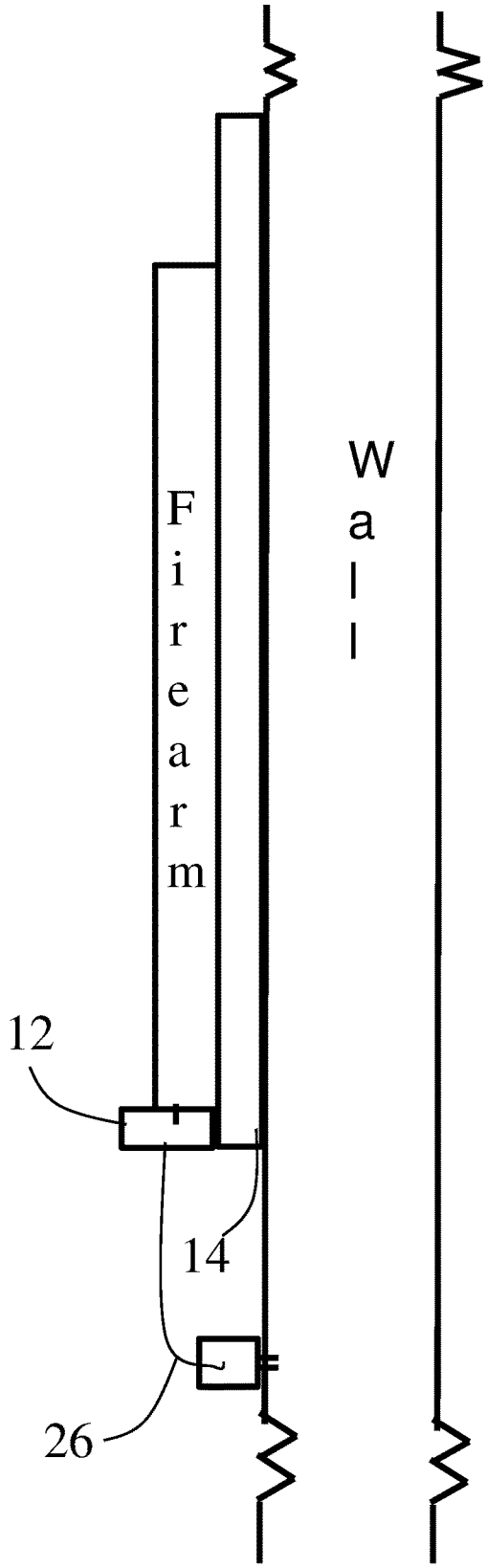

FIG. 5A-5C depict cross-sections of various exemplary embodiments of the firearm storage device 14 including the firearm monitoring device 12 storing a firearm, such as a firearm storage case. The embodiments shown in FIG. 5A depicts three sensors 22 as part of the firearm monitoring device 12. These sensors may include pressure, motion, light, and/or RFID sensors proximate the firearm in the storage device 14 and contact, RFID, etc. sensors positioned to detect the opening of the firearm storage device 14. Other sensors may be provided that do not need to be proximate to the firearm or the opening of the storage device 14, such as accelerometers and gyroscopes, to provide sense signals. FIGS. 5B & 5C depict the device 12 in use with horizontal and vertical storage device 14 embodiments, such as racks and mounts.

In various embodiments, the firearm monitoring device 12 may include a battery (not shown) and a power cord 26 for charging the battery or powering the device 12 directly. An antenna may be provided connecting to the communication interface 24 to facilitate wireless network connectivity, which may be integrated into the same cabling as the power cord 26 or provided separately. In various embodiments, the firearm monitoring device 12 may be configured to notify the monitoring platform 16 and/or user 18, if the device 12 switches from receiving electrical from an external power source via the power cord 26 to the battery, which may indicate a change in environment proximate the device 12. Upon a change of power supply notification, the system 10 may enable the user 18 or monitoring platform 16 to take action, such as locking the firearm, calling the police or location of the device 12, etc. In various embodiments, multi-factor authentication may be enabled if the power cord 26 is unplugged and/or a communication disruption between the device and the platform 16.

The firearm storage device 14 may also include a lock that may be operated physically and/or locally or remotely via the firearm monitoring platform 16, such as via the mobile application by the user 18 and/or a device monitoring service. The system 10 may be configured that the user and/or monitoring services receives a notification when the lock is locked or unlocked and whether it was locked or unlocked physically or via the software running on the mobile application and/or platform 16. In various embodiments, the locking device may be further controlled by the system 10, such that it can not be unlocked except by the system 10 and/or in the presence of a trusted device or other multi-factor authentication technique, irrespective of whether a person attempting to access the firearm has the proper key/code/fingerprint/etc. to unlock the storage device 14. The trusted device may be a mobile phone or other device that the user has registered with the platform.

In various embodiments, the firearm storage device 14 may also include a Global Positioning System ("GPS") or other tracking technology, e.g. RF beacons, that may be used to track the device 14 via the platform 16.

It will be appreciated that the present invention, e.g., device 12 and platform 16, may also be used to monitor other objects, e.g. jewelry, ammo, medication and other products, metals and other commodities, currency, documents, etc., suitable for storage and monitoring as described herein.

Figure 6:
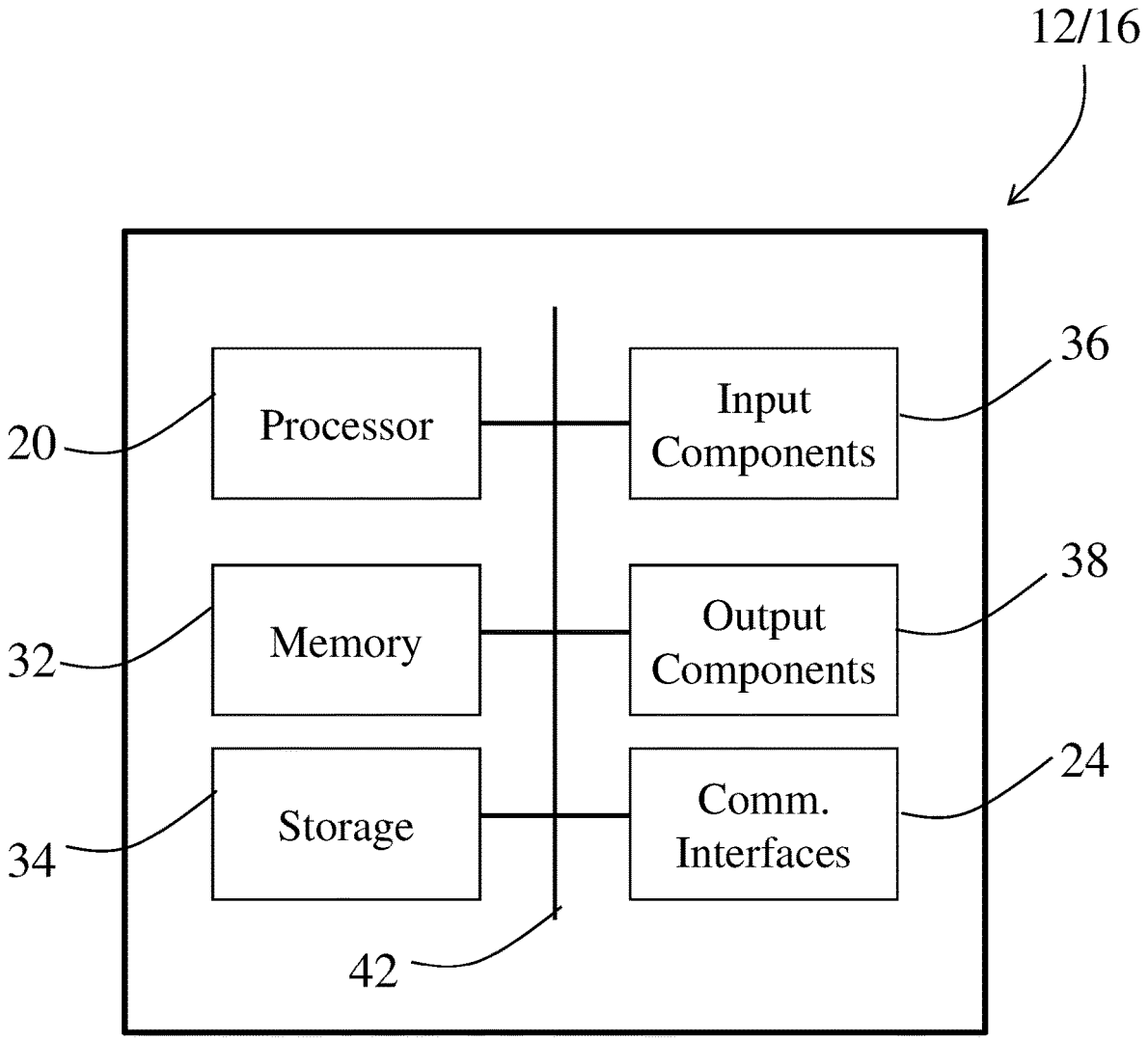
FIG. 6 illustrates exemplary components of devices and platforms for use in the present invention.

FIG. 6 illustrates exemplary component embodiments of various computing resources 12 that may be employed in the system 10 and running various applications. The computing resources may each include one or more processors 20, memory 32, storage 34, input components 36, output components 38, communication interfaces 24, as well as other components that may be interconnected as desired by the skilled artisan via one or more buses 42. As previously described, the components of the various computing resources may often be configured as a single device or multiple interdependent or stand-alone devices in close proximity and/or distributed over geographically remote areas.

Processor(s) 20 may include one or more general or Central Processing Units ("CPU"), Graphics Processing Units ("GPU"), Accelerated Processing Units ("APU"), microprocessors, and/or any processing components, such as a Field-Programmable Gate Arrays ("FPGA"), Application-Specific Integrated Circuits ("ASIC"), etc. that interpret and/or execute logical functions. The processors 20 may contain cache memory units for temporary local storage of instructions, data, or computer addresses and may be implemented as a single-chip, multiple chips and/or other electrical components including one or more integrated circuits and printed circuit boards that implements and executes logic in hardware, in addition to executing software.

Processor(s) 20 may connect to other computer systems and/or to telecommunications networks as part of performing one or more steps of one or more processes described or illustrated herein, according to particular needs. Moreover, one or more steps of one or more processes described or illustrated herein may execute solely at the processor 20. In addition, or as an alternative, one or more steps of one or more processes described or illustrated herein for execution in one processor may be executed at multiple CPUs that are local or remote from each other across one or more networks.

The computing resources of the system 10 may implement processes employing hardware and/or software to provide functionality via hardwired logic or otherwise embodied in circuits, such as integrated circuits, which may operate in place of or together with software to execute one or more processes or one or more steps of one or more processes described or illustrated herein. Software implementing particular embodiments may be written in any suitable programming language (e.g., procedural, object oriented, etc.) or combination of programming languages, where appropriate.

Memory 32 may include Random Access Memory ("RAM"), Read Only Memory ("ROM"), and/or another type of dynamic or static storage device, such as flash, magnetic, and optical memory, etc. that stores information and/or instructions for use by processor 20. The memory 32 may include one or more memory cards that may be loaded on a temporary or permanent basis. Memory 32 and storage 34 may include a Subscriber Identification Module ("SIM") card and reader.

Storage components 24 may store information, instructions, and/or software related to the operation of the system 10 and computing resources. Storage 34 may be used to store operating system, executables, data, applications, and the like, and may include fast access primary storage, as well as slower access secondary storage, which may be virtual or fixed.

Storage component(s) 24 may include one or more transitory and/or non-transitory computer-readable media that store or otherwise embody software implementing particular embodiments. The computer-readable medium may be any tangible medium capable of carrying, communicating, containing, holding, maintaining, propagating, retaining, storing, transmitting, transporting, or otherwise embodying software, where appropriate, including nano-scale medium. The computer-readable medium may be a biological, chemical, electronic, electromagnetic, infrared, magnetic, optical, quantum, or other suitable medium or a combination of two or more such media, where appropriate. Example computer-readable media include, but are not limited to fixed and removable drives, ASIC, Compact Disks ("CDs"), Digital Video Disks ("DVDs", FPGAs, floppy disks, optical and magneto-optic disks, hard disks, holographic storage devices, magnetic tape, caches, Programmable Logic Devices ("PLDs"), RAM devices, ROM devices, semiconductor memory devices, solid state drives, cartridges, and other suitable computer-readable media.

Input components 36 and output components 38 may include various types of Input/Output ("I/O") devices. The I/O devices often may include a Graphical User Interface ("GUI") that provides an easy to use visual interface between the user and system 10 and access to the operating system or application(s) running on the devices.

Input components 36 receive any type of input in various forms from users or other machines, such as touch screen and video displays, keyboards, keypads, mice, buttons, track balls, switches, joy sticks, directional pads, microphones, cameras, transducers, card readers, voice and handwriting inputs, and sensors for sensing information such as biometrics, temperature & other environmental conditions, such as air quality, etc., location via GPS or otherwise, accelerometer, gyroscope, compass, actuator data, which may be input via a component in the user device 12 and/or received via one or more communication interfaces 30.

Output component 28 may include displays, speakers, lights, sensor information, mechanical, or other electromagnetic output. Similar to the input, the output may be provided via one or more ports and/or one or more communication interfaces 30.

Communication interface 30 may include one or more transceivers, receivers, transmitters, modulators, demodulators, radios, etc. that enable communication with other devices, via wired and/or wireless connections. Communication interface 30 may include Ethernet, optical, coaxial, Universal Serial Bus ("USB"), Infrared ("IR"), Radio Frequency ("RF") including the various Wi-Fi, WiMax, cellular, and Bluetooth protocols, such as Bluetooth, Bluetooth Low Energy (BLE), Wi-Fi (IEEE 802.11), Wi-Fi Direct, SuperWiFi, 802.15.4, WiMax, LTE systems, LTE Direct, past, current, and future cellular standard protocols, e.g., 4-5G, or other wireless signal protocols or technologies as described herein and known in the art.

Bus(es) 42 may connect a wide variety of other subsystems, in addition to those depicted, and may include various other components that permit communication among the components in the computing resources. The bus(es) 42 may encompass one or more digital signal lines serving a common function, where appropriate, and various structures including memory, peripheral, or local buses using a variety of bus architectures. As an example and not by way of limitation, such architectures include an Industry Standard Architecture ("ISA") bus, an Enhanced ISA ("EISA") bus, a Micro Channel Architecture ("MCA") bus, a Video Electronics Standards Association Local Bus ("VLB"), a Peripheral Component Interconnect ("PCI") bus, a PCI-extended ("PCI-X") bus, a Peripheral Component Interconnect Express (PCIe) bus, a Controller Area Network ("CAN") bus, and an Accelerated Graphics Port ("AGP") bus.

The computing resources of the system 10 may provide functionality as a result of the processors 20 executing software embodied in one or more computer-readable storage media residing in the memory 32 and/or storage 34 and logic implemented and executed in hardware. The results of executing the software and logic may be stored in the memory 32 and/or storage 34, provided to output components 38, and transmitted to other devices via communication interfaces 30, which includes cloud storage and cloud computing. In execution, the processor 20 may use various inputs received from the input components 36 and/or the communications interfaces 30. The input may be provided directly to the processor 20 via the bus 42 and/or stored before being provided to the processor 20. Executing software may involve carrying out processes or steps may include defining data structures stored in memory 32 and modifying the data structures as directed by the software.

As used herein, the term component is intended to be broadly construed as hardware, firmware, and/or a combination of hardware and software. It will be apparent that systems and/or methods, described herein, may be implemented in different forms of hardware, firmware, or a combination of hardware and software. The actual specialized control hardware or software code used to implement these systems and/or methods is not limited to the implementations. Thus, the operation and behavior of the systems and/or methods were described herein without reference to specific software code—it being understood that software and hardware can be designed to implement the systems and/or methods based on the description herein.

Certain user interfaces have been described herein and/or shown in the figures. A user interface may include a graphical user interface, a non-graphical user interface, a text-based user interface, etc. A user interface may provide information for display. In some implementations, a user may interact with the information, such as by providing input via an input component of a device that provides the user interface for display. In some implementations, a user interface may be configurable by a device and/or a user (e.g., a user may change the size of the user interface, information provided via the user interface, a position of information provided via the user interface, etc.). Additionally, or alternatively, a user interface may be pre-configured to a standard configuration, a specific configuration based on a type of device on which the user interface is displayed, and/or a set of configurations based on capabilities and/or specifications associated with a device on which the user interface is displayed.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

The foregoing disclosure provides examples, illustrations and descriptions of the present invention, but is not intended to be exhaustive or to limit the implementations to the precise form disclosed. Modifications and variations are possible in light of the above disclosure or may be acquired from practice of the implementations. These and other variations and modifications of the present invention are possible and contemplated, and it is intended that the foregoing specification and the following claims cover such modifications and variations.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items and may be used interchangeably with "one or more." Furthermore, as used herein, the term "set" is intended to include one or more items and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

Furthermore, all elements listed by name, such as firearm, sensor, storage device, monitoring, mechanism, and radio frequency identification encompass all equivalents for such elements. For example, in addition to a "safety" any means or mechanism to ensure against the accidental discharge of a firearm to help ensure safer handling is also contemplated by the present invention. Such equivalents are contemplated for each element named herein. Also, while the invention will be described in connection with firearms, it is understood that the invention is not limited in scope to use with firearms as described above.

For purposes of summarizing, certain aspects, advantages, and novel features of the present invention are provided herein. It is to be understood that not all aspects, advantages, or novel features may be provided in any one particular embodiment. Thus, the disclosed subject matter may be embodied or carried out in a manner that achieves or optimizes one aspect, advantages, or novel features or group of features without achieving all aspects, advantages, or novel features as may be taught or suggested.

What is claimed is:

1. A firearm monitoring system comprising:

a firearm storage device configured to store a firearm;

a firearm monitoring platform in communication with a user; and a firearm monitoring device including at least one processor and memory, at least one sensor, and at least one communication interface, the at least one sensor positioned to sense when the firearm stored in the firearm storage device changes position relative to the sensor, the at least one processor configured to:

receive sense signals from the at least one sensor, determine whether the sense signals represent a change in position of the firearm relative to the at least one sensor, and send, via the at least one communication interface and the firearm monitoring platform, a change in position notification to the user when the at least one processor determines there has been a change in position of the firearm relative to the at least one sensor;

receive, via the at least one communication interface and the firearm monitoring platform, instructions regarding the firearm storage device from the user; and execute, via the at least one processor, the instructions received from the firearm monitoring platform, and the firearm monitoring platform being remote from the firearm storage device and configured to communicate with firearm monitoring device and the user, monitor the status of the firearm monitoring device, notify the user of firearm monitoring device status, and communicate instructions from the user to the firearm monitoring device.

2. The system of claim 1, where the at least one sensor includes at least one of pressure, motion, contact, RFID, light, reed switches, gyroscope, and accelerometer sensors.

3. The system of claim 1, where the at least one communication interface includes at least one of a transmitter and a transceiver configured to at least send signals via at least one of WiFi, Bluetooth, and cellular protocols.

4. The system of claim 1, where the firearm storage device is one of a holster, case, rack, and safe.

5. The system of claim 1, where the at least one sensor is positioned to sense when the firearm is moved from a position within the firearm storage device.

6. The system of claim 1, where at least one of the at least one sensor is positioned to sense when the firearm storage device is one of opened and unlocked; and the processor is further to send one of an opened and unlocked notification to the user.

7. The system of claim 1, where at least one sensor is a contact sensor.

8. The system of claim 1, where the firearm monitoring device is positioned in the firearm storage device.

9. The system of claim 1, where the firearm monitoring device provides for GPS tracking of the firearm monitoring device.

10. The system of claim 1, where the firearm monitoring platform stores settings for the firearm monitoring device and notifications sent by the firearm monitoring device.

11. The system of claim 1, where the firearm storage device includes a lock configured to be unlocked and locked remotely by the user via the firearm monitoring platform.

12. The system of claim 1, where the firearm monitoring platform includes a software as a service application accessible via a browser interface and a software application running on one of a mobile phone and a tablet of the user communicating with the firearm monitoring device via at least one the software as a service application and directly.

13. The system of claim 1, where the at least one sensor includes at least one sensor to detect movement of the firearm, a gyroscope to detect movement of the firearm storage device, and at least one sensor to detect opening of the firearm storage device.

14. A method of monitoring a firearm comprising:

providing a firearm monitoring device including at least one processor and memory, at least one sensor, and at least one communication interface and a firearm monitoring platform in communication with the firearm monitoring device and a user;

positioning at least one sensor to sense when a firearm stored in a firearm storage device moves relative to the sensor;

receiving, via the at least one processor, sense signals from the at least one sensor;

determining, via the at least one processor, whether the sense signals represent a change in position of one of the firearm and the firearm storage device relative to the at least one sensor;

sending, via at least one communication interface and a firearm monitoring platform, a change in position notification to the user via the at least one communication interface when the processors determine there has been a change in position of the firearm relative to the at least one sensor;

receiving, via the at least one communication interface and the firearm monitoring platform, instructions regarding the firearm storage device from the user; and executing, via the at least one processor, the instructions received from the user via the firearm monitoring platform.

15. The method of claim 14, further comprising receiving, via a user device, the change in position notification from the firearm monitoring device; and presenting, via the user device, an option of communicating with at least one of a 911 call center and other contacts.

16. The method of claim 14, further comprising outputting, via the firearm monitoring device, an alert proximate the firearm monitoring device when there has been a change in position determination.

17. The method of claim 14, where outputting includes at least one of emitting light, sound, and vibration.

18. The method of claim 14, where executing includes disabling a fingerprint sensor lock.

19. The method of claim 14, where executing includes preventing a lock from being unlocked.

20. A non-transitory computer readable medium storing instructions for firearm monitoring, the instructions comprising:

one or more instructions stored in memory which, when executed by one or more processors, cause the one or more processors:

receive sense signals from at least one sensor positioned to sense when a firearm stored in a firearm storage device changes position relative to the at least one sensor;

determine whether the sense signals represent a change in position of the firearm relative to the at least one sensor and the firearm storage device is unlocked;

send, via at least one communication interface and a firearm monitoring platform, a notification to a user when the change in position and unlocking of the firearm storage device is determined;

receive, via the at least one communication interface and the firearm monitoring platform, instructions regarding the firearm storage device; and execute the instructions received from the firearm monitoring platform.

* * * * *